United States Patent [19]

Hosoya et al.

[11] Patent Number: 5,066,982

[45] Date of Patent: Nov. 19, 1991

[54] CLEANER-LESS IMAGE FORMING APPARATUS

[75] Inventors: Masahiro Hosoya, Okegawa; Mitsunaga Saito, Tokyo; Shuitsu Sato, Kawasaki; Yoshimitsu Ohtaka, Mishima; Mitsuharu Endo, Susono; Yukio Futamata, Shizuoka, all of Japan

[73] Assignees: Kabushiki Kaisha Toshiba, Kanagawa; Tokyo Electric Co., Ltd., Tokyo, both of Japan

[21] Appl. No.: 501,864

[22] Filed: Mar. 30, 1990

[30] Foreign Application Priority Data

Mar. 31, 1989 [JP] Japan ..... 1-081921
Oct. 13, 1989 [JP] Japan ..... 1-266815

[51] Int. Cl.[5] ..... G03G 15/06; G03G 15/24

[52] U.S. Cl. ..... 355/269; 118/652; 355/270; 355/296

[58] Field of Search ..... 355/269, 270, 296, 297, 355/299, 301, 303; 118/652, 651, 653

[56] References Cited

U.S. PATENT DOCUMENTS

| | | | |
|---|---|---|---|
| 3,617,123 | 11/1971 | Emerson | 355/270 X |
| 4,443,095 | 4/1984 | Tsushima et al. | 355/326 |
| 4,571,066 | 2/1986 | Morrison | 355/270 |
| 4,769,676 | 9/1988 | Mukai et al. | 355/269 |

FOREIGN PATENT DOCUMENTS

| | | | |
|---|---|---|---|
| 0129642 | 11/1978 | Japan | 355/301 |
| 0033470 | 2/1984 | Japan | 355/269 |
| 59-133573 | 7/1984 | Japan . | |
| 0282875 | 12/1986 | Japan | 355/270 |
| 62-203182 | 9/1987 | Japan . | |
| 64-50089 | 2/1989 | Japan . | |
| 2129372 | 5/1984 | United Kingdom | 355/303 |

*Primary Examiner*—Arthur T. Grimley
*Assistant Examiner*—William J. Royer
*Attorney, Agent, or Firm*—Finnegan, Henderson, Farabow, Garrett, and Dunner

[57] ABSTRACT

In a first embodiment of the present invention, a plurality of electrode portions are contactably and approachably disposed on an electrostatic latent image holding member in order to equalize a toner image of an electrostatic latent image holding member. In a second embodiment, an elastic foaming apparatus is contactably or approachably disposed to the electrostatic latent image holding member in order to equalize the residual toner distribution on the electrostatic latent image holding member. In a third embodiment, an equalization member consisting of an electric conductor or a resistor is contactably and approachably disposed on the electrostatic latent image holding member in order to equalize the distribution of toner of the transfer residual toner image. An AC electric field may be generated between the equalization member and the electrostatic latent image holding member.

21 Claims, 12 Drawing Sheets

CLEANER-LESS IMAGE FORMING APPARATUS

BACKGROUND OF THE INVENTION

1. Field of the Invention

The present invention relates to an image forming apparatus based on an electrophotographic system, specifically to a cleaner-less image forming apparatus without using cleaning means for cleaning residual toner.

2. Description of the Related Art

In an image forming apparatus based on the electrophotographic system, recording apparatuses wherein a development unit collects residual toner therein while developing an image (named hereinafter the cleaner-less recording apparatus) have been known, for example, in Japanese patent laid-open No. SHO 59-133573 publication document and SHO 59-157661 publication document. In these documents, a basic concept of the cleaner-less image forming apparatus is disclosed. The outline of the concept is summarized as follows. In electrophotographic printers such as laser printers, the reversal development method has been widely used.

In the reversal development method, toner particles which are charged with the same polarity as an electrostatic latent image holding member (photosensitive material) are used, the toner particles being adhered to the portions where electric charge is absent or where the amount of electric charge is low on the electrostatic latent image holding member; the toner particles being not adhered to the portions where electric charge is present thereon. To selectively adhere toner particles, voltage $V_b$ ($|V_l| < |V_b| < |Vo|$) which is between voltage Vo of the charged portion on the electrostatic latent image holding member and voltage $V_l$ of the non-charged portion thereon is applied to the toner holding member of the development unit. The electric field of the charged portion prevents the toner from being adhered to the electrostatic latent image holding member. On the other hand, the electric field of the non-charged portion causes the toner to be adhered to the electrostatic latent image holding member.

The toner adhered on the electrostatic latent image holding member is transferred to an image holding material by a known transfer unit. In the image transfer process, all the toner particles are not transferred to the image holding material. Instead, the residual toner distributively stays in an image shape on the electrostatic latent image holding member.

In the conventional electrophotographic apparatus, the residual toner is collected by a cleaner and the electric charge which stays on the electrostatic latent image holding member is cleared by a charge clearing lamp. After that, a latent image forming process (consisting of a charge equalization process by a charger and an exposure process by a light beam) is performed. On the other hand, in the cleaner-less image forming apparatus, the residual toner is collected in the development unit while performing a development process without using such a cleaner. Strictly speaking, since the residual toner which is present in the charged portion (non-exposure portion or non-image portion) of the latent image formed in the light beam exposure process is securely charged with the same polarity as the latent image by the charger, an electric field which prevents the toner particles from moving from the toner holding member to the electrostatic latent image holding member, namely, the electric field produced by a potential of Vo and $V_b$, the residual toner is moved to the toner holding member side. At the same time, the residual toner which is present in the non-charged portion (exposure portion or image portion) is urged by a force which works from the toner holding member to the electrostatic latent image holding member. Thus, the residual toner stays on the electrostatic latent image holding member, new toner particles being moved from the toner holding member to the non-charged portion. Consequently, while an image is developed, the residual toner is cleaned.

As described above, in the cleaner-less image forming apparatus, since it is not necessary to provide the cleaner and a waste toner box which stores collected toner (waste toner), the apparatus can be easily and simply structured in a small size. In addition, the residual toner is collected in the development unit and then reused therein. Thus, no waste toner occurs and thereby the cost performance increases. In addition, since the surface of the electrostatic latent image holding ember is not slid by a cleaning blade, the life of the electrostatic latent image holding member can be prolonged. Thus, the cleaner-less image forming apparatus has many benefits like above. However, in the conventional cleaner-less image forming apparatuses, ghost images may occur due to the following causes.

Firstly, in a high humidity environment, a paper as the image holding material absorbs moisture and thereby the resistance decreases. Thus, generally there is a tendency for the transfer efficiency to decrease and for a significant amount of toner to stay on the electrostatic latent image holding member. In other words, when the resistance of the transfer recording paper decreases due to absorption of moisture or the transfer conditions are not optimum values due to disconformity of the material and thickness, there is a tendency for the toner to stay massively on the electrostatic latent image holding member. In the worst case, in the transfer process, the transfer recording paper is not contacted with the electrostatic latent image holding member due to a wrinkle of the recording paper and thereby the desired transfer operation may not take place.

When the amount of residual toner becomes excessive, the required cleaning operation cannot be conducted in the development position and the residual toner stays in the non-image section. Thus, a positive ghost appears in the white portion of the transfer image which is named the positive ghost or positive memory hereinafter.

Secondly, when the amount of residual toner becomes excessive, since the residual toner shields the light beam in the exposure process, an insufficient attenuation of the potential of the electrostatic latent image holding member takes place. In this portion, since the development voltage becomes $V_b - Vl'$ ($Vo < Vl' < V_l$) which is smaller than the development voltage $V_b - Vl$ of the surrounding exposure portion. Thus, the amount of toner which is transferred from the toner holding member to the latent image holding material becomes smaller than other surrounding portions. Thus, at the image portion of the transfer image, a white drop image takes place by the residual toner image. The white drop image is named the negative ghost or negative memory hereinafter. This phenomenon remarkably occurs in a half tone image consisting of a combination of blind spot images and line images.

To solve the above problem, for example, Japanese patent laid-open No. SHO 62-203183, No. SHO 64-50089, and SHO 64-50089 publication documents disclose that by applying a voltage to an electro-conductive brush, that slightly contacts an electrostatic latent image holding member, the ghost can be cleared. In other words, by applying a voltage whose polarity is reverse of that of the toner being charged to the electro-conductive brush by a DC power supply, the residual toner is attracted to the electro-conductive brush by means of the Coulomb's force. On the other hand, at the non-image portion of the electrostatic latent image holding member, the toner which is positively charged is emitted from the single electrode type brush. In such a manner, the residual toner is equally distributed. Thus, the amount of the residual toner on the electrostatic latent image holding member is remarkably reduced, thereby preventing the ghost from occurring.

However, in the method where the residual toner is attached and removed by the above electro-conductive brush, the following problem will arise.

Firstly, although for a laser printer, a high resolution image is required, because of excessive residual toner which shields a light beam, the memory phenomenon often occurs. Thus, the allowable toner density should be very low. However, it is very difficult to satisfy such a requirement which reduces the amount of the residual toner to the allowable level.

Secondly, for an image forming apparatus, in various environmental conditions, images are transferred to various recording papers. In this situation, the charging polarity and the charging amount depend on the resistance of each recording paper. For example, when the resistance of the recording paper is low, the positive electric charge which is applied from a transfer unit 5 to the recording paper is moved to the direction of the thickness of the recording paper and arrives at the toner particles on the electrostatic latent image holding member. Thus, the polarity of the toner is reversed and thereby it is positively charged. In addition, the surface of the electrostatic latent image holding member is positively charged. Thus, the single electrode type brush produces a repulsive force against the residual toner rather than attracting it. Thus, the function for preventing the memory phenomenon from occurring cannot be performed.

Thirdly, the residual toner is emitted to the non-image portion. Particularly, when the single electrode type brush excessively attracts the residual toner, the amount of emitted toner increases, thereby shielding the exposure beam. Thus, an image defect may occur.

Fourthly, since the single electrode type brush has a limit for attracting and holding the toner, when the amount comes to the limit, the brush does not attract the residual toner. Thus, the memory protection function does not work.

This point will be described in detail. FIG. 1 shows the amount of residual toner adhered (curve A) and the amount of charging against transfer corona voltage $V_t$ (curve B). In other words, when the transfer corona voltage $V_t$ becomes approximately 5.0 kV, the transfer efficiency becomes maximum and thereby the amount of the residual toner adhered becomes minimum. When the transfer corona voltage $V_t$ becomes approximately 5.0 kV, the charging polarity of the residual toner is reversed from the negative to the positive and the amount of charging of the residual toner becomes approximately 0. In other words, the electric charge which is transferred from the transfer unit to the recording paper is moved in the direction of the thickness of the recording paper and arrives at the toner on the electrostatic latent image holding member. Thus, the toner which has been negatively charged is gradually neutralized by the positive electric charge. Consequently, it can be considered that the transfer corona voltage $V_t$ is a factor for restricting the electric charge which is emitted to the toner. For example, by keeping the transfer corona voltage $V_t$ constant and changing the material, thickness, moisture rate, and so forth of the paper, even if the resistance is changed, the same result takes place.

For example, FIG. 2 shows the relationship between the residual toner density after the development unit cleans the surface of the electrostatic latent image holding member while developing an image, the unit applying a predetermined corona voltage to the transfer unit to transfer the image to the transfer paper (curve C) and after the toner is passed though the single electrode type brush (curve D). The residual toner density after the toner image is transferred to a photosensitive drum 1 was measured by using a method disclosed in Japanese patent laid-open No. SHO 64-50089 publication document. For example, the toner image on the photosensitive drum 1 is transferred to a mending tape. The mending tape is adhered on a white paper and the reflection density is measured (when the toner is absent, the reflection density of the mending tape is approximately 0.11, which is named the tape density).

As shown in FIG. 2, the residual toner density becomes minimum when the corona voltage $V_t$ is 4.9 kV (approximately 0.23). In the vicinity of the voltage, the density increases. On the other hand, after the toner is passed through the single electrode type brush, the residual toner density becomes minimum when the corona voltage $V_t$ is 4.4 kV. When the corona voltage $V_t$ is 4.9 kV or more, the residual toner density after the toner is passed through the single electrode type brush follows with the curve of the residual toner density after the toner is transferred. This is because in the vicinity of $V_{t=4.9}$ kV (the amount of residual toner adhered after the toner is transferred becomes minimum), the charging amount of the residual toner after the toner is transferred is nearly zero and in the vicinity the electric charging polarity is reversed as shown in FIG. 1. FIG. 3 shows a descriptive diagram showing this phenomenon. The figure shows the attraction and emission of the toner and the surface voltage Vo of the electrostatic latent image holding member at the contact portion between the single electrode type brush and the electrostatic latent image holding member and Vo of the surface voltages of the image portion and the non-image portion of the electrostatic latent image holding member.

In the case that the transfer corona voltage $V_t$ is 4.4 kV:

The density decreases near to density 0.11 of tape on a white paper (named the tape density hereinafter) where the single electrode type brush attracts the residual toner and the toner is not adhered on the surface of the electrostatic latent image holding member. When, in the single electrode type brush position, the surface potential of the electrostatic latent image holding member slightly changes in the positive direction both for the image portion and the non-image portion. Since the residual toner is negatively charged as shown in FIG. 1, the residual toner is attracted by the single electrode type brush where a positive voltage is applied. At the non-image portion, the positively charged toner particles (part of toner particles are positively charged by frictions between toner particles, between toner particles and the single electrode type brush, and between the toner particles and the electrostatic latent image holding member, by charge injection, and by discharging) are emitted onto the electrostatic latent image holding member and the electric charge is moved among the single electrode type brush, the electrostatic latent image holding member, and the toner particles. Thus, after the toner is passed through the single electrode type brush, the residual toner is equalized and the surface voltage of the electrostatic latent image holding member nearly becomes constant.

In the case that the transfer corona voltage is 4.9 kV:

Since the single electrode type brush almost does not attract the toner, there is nearly no difference between the residual toner density after the toner is transferred and that after it is passed through the single electrode type brush. At the time, in the single electrode type brush position, the surface potential of the electrostatic latent image holding member changes in the positive direction both for the image portion and non-image portion since positive electric charge is fed from the transfer unit (particularly, for the non-image portion, the potential remarkably changes and thereby the potential between the image portion and the non-image portion is reduced). As shown in FIG. 1, since the charging amount of the residual toner is nearly 0 and the potential between the single electrode type brush voltage $V_w$ and the voltage of the image portion is small, the Coulomb's force which acts on the residual toner is small and thereby the residual toner is still adhered on the surface of the electrostatic latent image holding member. On the other hand, at the non-image portion, since the toner is not attracted by the single electrode type brush, the amount of toner positively charged is small. In addition, since the potential between the single electrode type brush and the non-image portion is small, the amount of toner which is emitted to the single electrode type brush is small. Moreover, since the amount of electric charge which moves is small because of the above reason and the surface voltage slightly changes, even after the toner is passed through the single electrode type brush, the residual toner is not equalized.

In the case that the transfer corona voltage $V_t=5.4$ kV:

As shown in FIG. 2, there is almost no difference between the residual toner density after the toner is transferred and that after it is passed through the single electrode type brush. In other words, like the case of the transfer corona voltage $V_t=4.9$ kV described above, the surface voltage of the electrostatic latent image holding member remarkably changes in the positive direction. On the other hand, as shown in FIG. 1, since the charging polarity of the residual toner is positive, the Coulobm's force acts so that the toner is adhered on the surface of the electrostatic latent image holding member. Thus, even after the toner is passed through the single electrode type brush, the residual toner is not equalized.

As described above, in the memory phenomenon protection or memory clearing method using the single electrode type brush (positive voltage is applied), only in the range where the charging polarity of the toner is negative, the toner is attracted and emitted and thereby in the vicinity where the charging amount becomes 0 (where the residual toner density after the toner is transferred becomes a minimum value), the residual toner density does not change. In other words, in the conventional method, for the residual toner density which is required for forming images in high resolution, equalization of the residual toner, memory phenomenon protection, and memory clearance cannot be satisfactorily accomplished.

SUMMARY OF THE INVENTION

The first means according to the present invention with respect to the cleaner-less image forming apparatus has means for equalizing a toner image of an electrostatic latent image holding member, which comprise a plurality of electrode portions contactably and approachably disposed on the electrostatic latent image holding member.

The second means according to the present invention with respect to the cleaner-less image forming apparatus as an equalization member consisting of an elastic forming substance for disturbing a transfer residual toner of the electrostatic latent image holding member and equalizing the toner distribution, the equalization member being contactably or approachably disposed to the electrostatic latent image holding member.

The third means according to the present invention with respect to the cleaner-less image forming apparatus has an equalization member consisting of an electric conductor or a resistor for disturbing a transfer residual toner image of the electrostatic latent image holding member and equalizing the distribution, the equalization member being contactably and approachable disposed on the electrostatic latent image holding member, an AC electric field being formed between the equalization member and the electrostatic latent image holding member.

DETAILED DESCRIPTION OF PREFERRED EMBODIMENTS

Embodiments according to the present invention will be described in the following.

The first means according to the present invention will be described.

According to the first means of the present invention, as residual toner image equalization means, a plurality of electrode members which have a potential are provided, for example, electro-conductive brushes are disposed contactably or approachably on an electrostatic latent image holding member, for example, a photosensitive drum. Thus, an electric field produced by the first electrode member to which the first voltage is applied and by the surface voltage of the photosensitive drum causes the first electrode member to attract or emit residual toner being charged. In addition, toner which is present between the first electrode member and the photosensitive drum causes toner and photosensitive drum to be charged or discharged. On the other hand, likewise, a second electrode member to which a second voltage is applied causes residual toner to be attracted or emitted and toner and photosensitive drum to be charged or discharged. At this time, there is a potential difference between the first voltage and the second voltage. Since the electric field produced at the first electrode member differs from that at the second electrode member, the attraction and emission characteristics of residual toner differ between them. In other words, toner which cannot be attached by the first electrode member is attracted by the second electrode member. On the other hand, toner which is emitted by the first electrode member is attracted by the second electrode member. When the charging condition of the residual toner after the toner is transferred, since the charging condition of the residual toner which is passed through the first electrode member is restricted by the first electrode member, the charging condition of the residual toner is stabled. Thus, by setting the second voltage of the second electrode member at a predetermined voltage, the stabled toner is easily attached or emitted. In other words, regardless of the environmental condition, recording paper type, and image pattern, the residual toner density can be further decreased so that the residual toner can be equalized. Consequently, the cleaner-less image forming apparatus allows various images to be formed in high quality.

Embodiment 1

Figure 4:
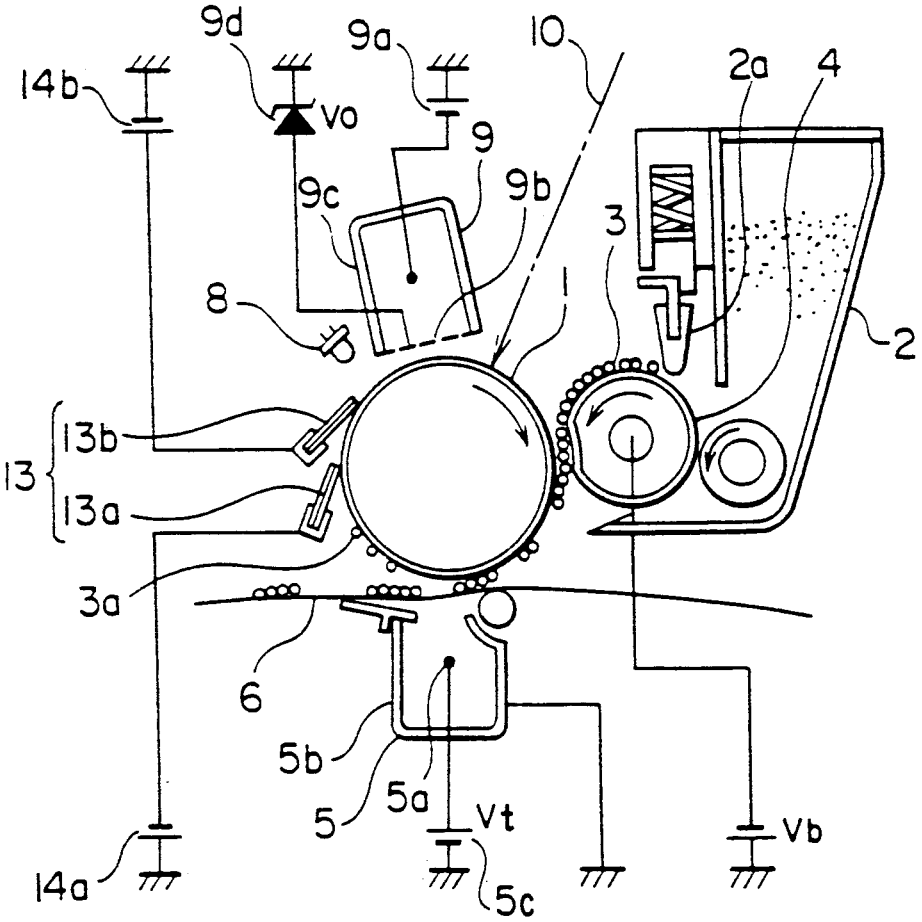
FIG. 4 is a sectional view showing an example of principal structure of the image forming apparatus according to the present invention.

FIG. 4 is a sectional view of the principal structure of the image forming apparatus according to the present invention. In the figure, 1 is an photosensitive drum for example, a photosensitive drum. 2 is a development unit comprising a development roller 4 whose surface is an elastic electro-conductive substance for holding and sending toner 3 which develops a latent image held on the photosensitive drum 1 and for properly collecting residual toner 3*a* after the toner is transferred. Corotron type transfer unit 5 transfers a formed image on the photosensitive drum 1 onto a transfer material 6, for example, a recording paper. 13 is residual toner image equalization means for equalizing the residual toner which stays on the photosensitive drum 1, namely, a plurality of electrode members 13*a* and 13*b*, for example, electro-conductive brushes, disposed contactably or approachably on the photosensitive drum 1, there being a potential between the electrode members 13*a* and 13*b*. 8 is a charge removing lamp for clearing residual electric charge which stays on the photosensitive drum 1 after the toner is transferred. 9 is a Scorotron type charger for applying a surface voltage that forms a new latent image on the photosensitive drum 1. 10 is exposure means using laser light for changing the surface voltage newly applied on the photosensitive drum 1 with exposure light so as to form a latent image.

The Corotron type transfer unit 5 comprises a shield case 5*b* having a wire 5*a* which is grounded and a transfer power supply 5*c* for applying a predetermined corona voltage $V_t$ to the wire 5*a*. The Scorotron type charger 9 for applying a surface voltage to the latent image holding material 1 so as to form a new latent image thereon is connected to a charging power supply 9*a*. A charging grid 9*b* and a shield case 9*c* are grounded through a zener diode 9*d* so that a predetermined voltage can be obtained. The first electro-conductive brush (negative) 13*a* and the second electro-conductive brush (positive) 13*b* as the residual toner image equalization means are connected to a power supply 14*a* and a power supply 14*b* for applying a corresponding negative voltage and a corresponding positive voltages thereto, respectively.

The image forming apparatus forms an image in the following manner. The charger 9 charges the surface of the photosensitive drum 1 at a predetermined charging voltage Vo ($Vo<0$). Then, the laser beam 10 causes a latent image to be formed. With this exposure process, at the exposure portion of the surface of the photosensitive drum 1, the surface potential decreases and residual voltage $V_r$ takes place. However, at the non-exposure portion, charging voltage Vo takes place.

After the latent image is formed, the development unit 2 cleans the residual toner and develops the latent image using the toner 3, for example, non-magnetic toner consisting of one component, which is charged with the same polarity (negative polarity) as the photosensitive drum 1. In other words, by using a a coating blade 2a on the development roller 4 which is a toner holding member, a nearly equal toner layer is formed and held. The voltage $V_b$ between Vo at the non-exposure portion (non-image portion) on the surface of the photosensitive drum 1 and voltage $V_r$ of the exposure portion (image portion) ($|V_r| < |V_b| < |Vo|$) is applied as a development voltage. By an electric field produced by the electrostatic latent image holding member (the photosensitive drum) 1, at the non-exposure portion (non-image portion), the adhesion of the toner is prevented. On the other hand, at the exposure portion (image portion), the toner is adhered. In this case, at the exposure portion, the residual toner 3a stays on the surface of the photosensitive drum 1, new toner being moved from the development roller 4. On the other hand, at the non-exposure portion, the residual toner 3a is moved to the development roller 4 and it is adhered thereon. In other words, the cleaning operation and the development operation are performed at the same time.

The toner adhered on the surface of the photosensitive drum 1 is transferred to the recording paper 6 by the transfer unit 5. However, all the toner is not transferred. On the surface of the photosensitive drum 1, the residual toner 3a is distributively adhered on the surface of the photosensitive drum 1 in an image shape. The residual toner on the surface of the photosensitive drum 1 is equalized by the residua toner image equalization means 13 and thereby a density level which is free of occurrence of the memory takes place. After the residual toner 3a on the surface of the photosensitive drum 1 is equalized, the surface of the photosensitive drum 1 is exposed by the charge removing lamp 8 and thereby electric charge thereon is cleared. After that, the charging and the exposure processes are executed.

Before describing the operation and effect of the above image forming apparatus, the result of evaluation we have made with respect to the relationship between the residual toner density and the memory occurrence ratio after the toner is transferred to the surface of the photosensitive drum 1 will be described by referring to FIG. 5.

The evaluation method we made is as follows. First, a full black image is formed. After the photosensitive drum 1 is rotated for one turn, images of 3 lines pair/mm and 6 lines pair/mm are formed. By determining whether the memory is present or absent in the images, the evaluation is made. As shown in FIG. 5, as the pair frequency is high such as 3 lines pair/mm and 6 lines pair/mm, the probability of occurrence of the memory against the residual toner density increases. We have the threshold value where the memory occurs in the image forming apparatus is approx. 0.2 of the residual toner density. In other words, when the residual toner density exceeds 0.2, the memory tends to occur.

Figure 5:
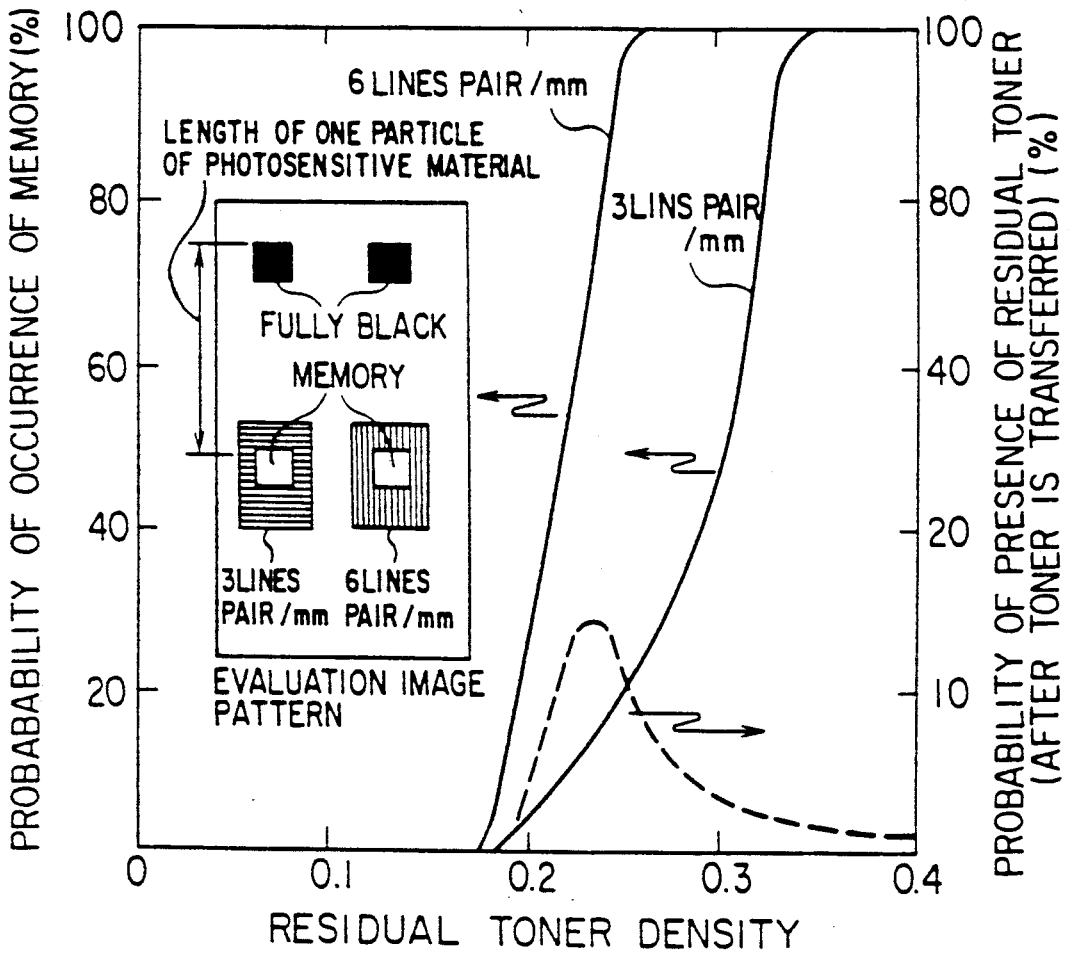
FIG. 5 is a chart showing an example of the relationship between the residual toner density after toner is transferred in the image forming apparatus according to the present invention and the memory occurrence rate.

FIG. 5 shows the probability where the density that the memory occurs is present against the residual toner density as the limit of the toner transfer (ratio where such density is present in the predetermined number of samples). Thus, it is obvious that the limit of the minimum residual toner density after the toner is transferred by the corona toner operation is approximately 0.2.

Figure 6:
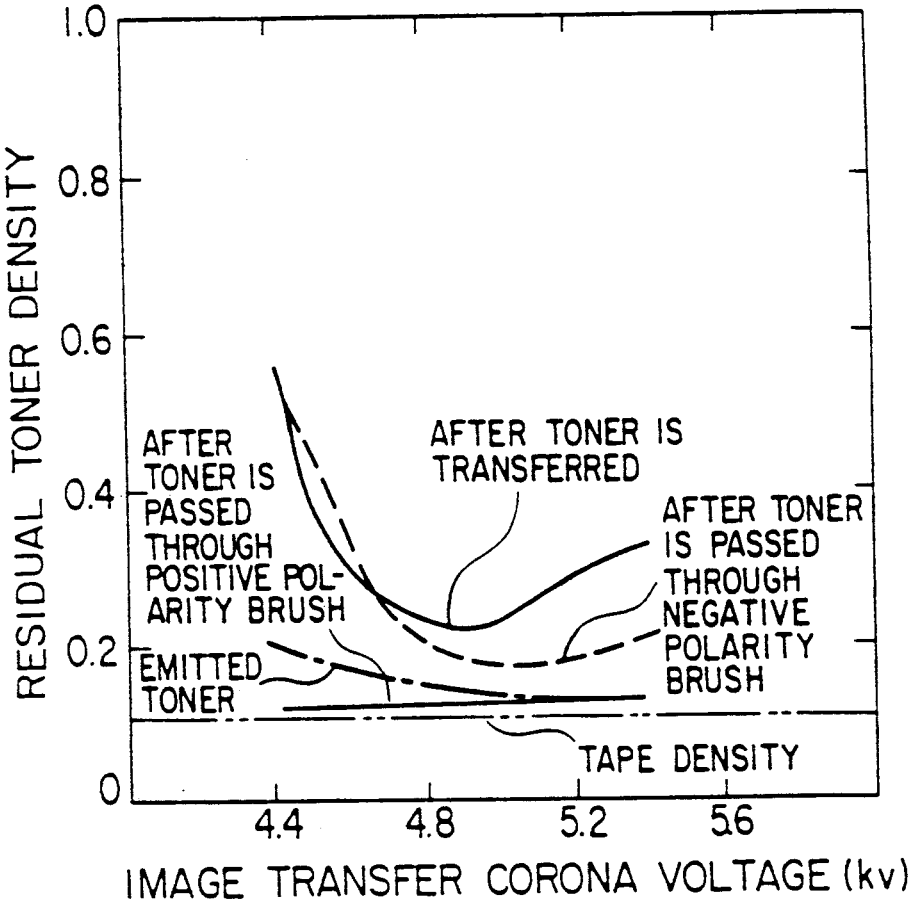
FIG. 6 is a chart showing the relationship between residual toner density and transfer corona voltage after toner is transferred and those after passed through the position of the residual toner cleaning means of the image forming apparatus according to the present invention.

With the image forming apparatus in the structure described above, in the same conditions as the conventional cleaning-less type laser printer except that a negative voltage and a positive voltage are applied to the first electro-conductive brush 13a and the second electro-conductive brush 13b, an image is formed. The results for measuring the residual toner density after the toner is transferred against the transfer corona voltage, that after the toner is passed through the first electro-conductive brush 13a and that after the toner is passed through the second electro-conductive brush 13b are shown in FIG. 6.

Figure 1:
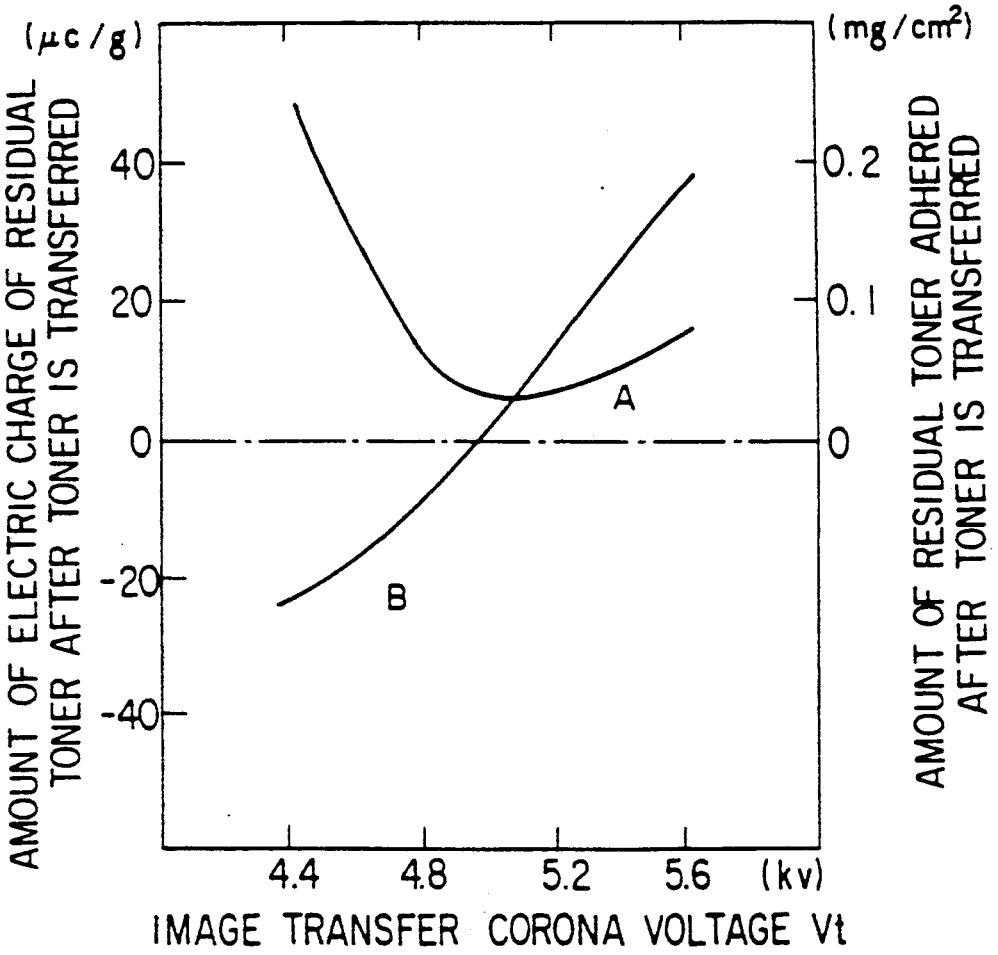
FIG. 1 PRIOR ART
FIG. 1 is a chart showinq the relationship among the amount of residual toner adhered, charging amount, and transfer corona voltage after toner is transferred in a conventional image forming apparatus with toner cleaning means.
Figure 2:
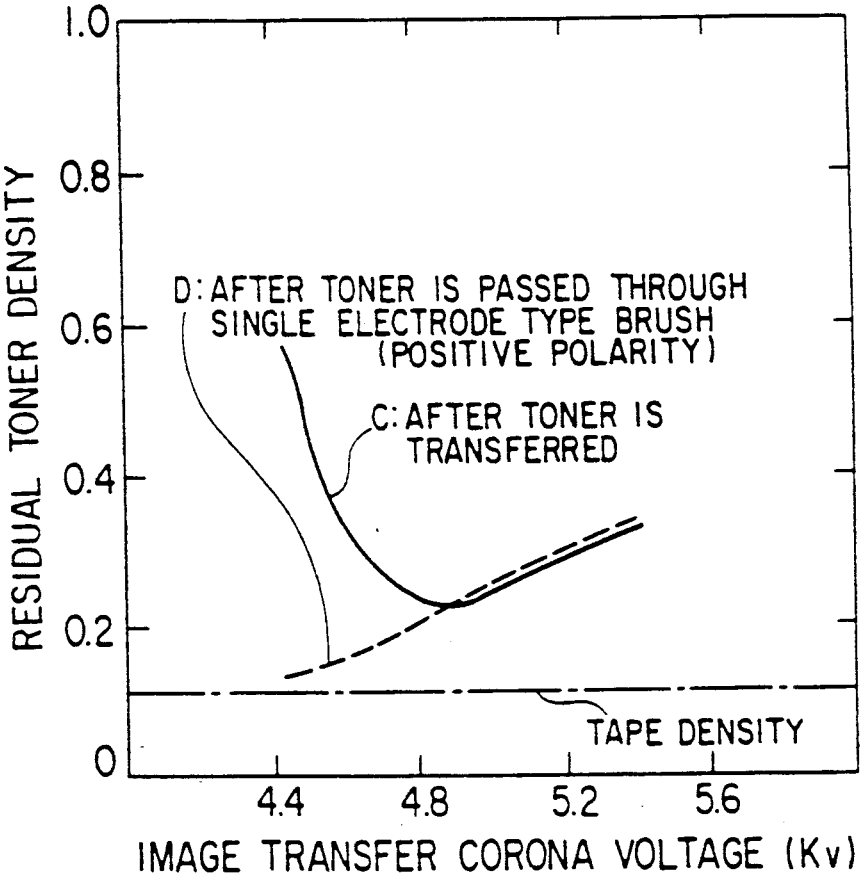
FIG. 2 PRIOR ART
FIG. 2 is a chart showing the position of the toner clearance means in the conventional image forming apparatus with toner clearance means and the relationship between residual toner density and transfer corona voltage after toner is passed through the position of the residual toner cleaning means.
Figure 3:
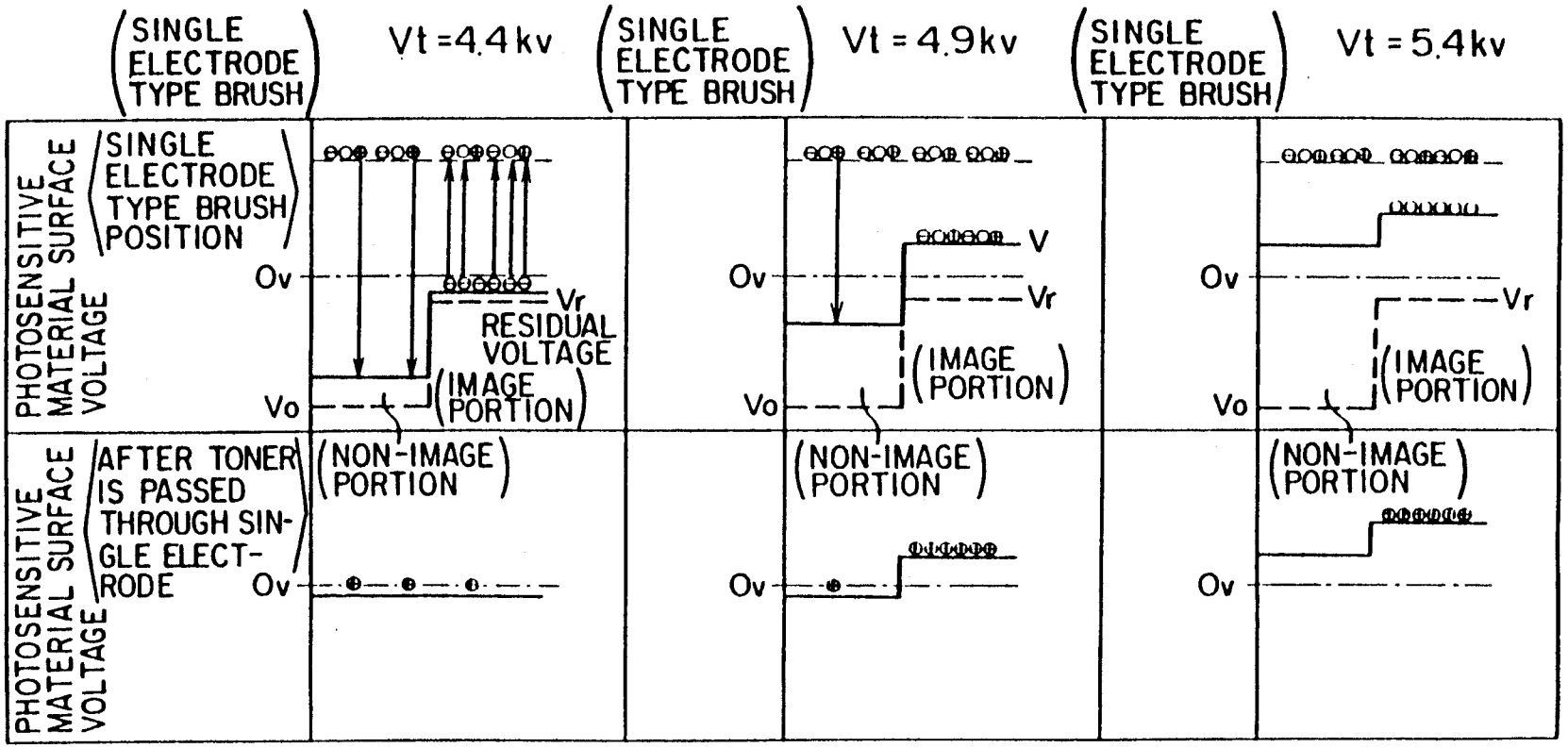
FIG. 3 PRIOR ART
FIG. 3 is a chart showing the relationship between a residual toner distribution and transfer corona voltage in the position of the toner cleaning means of the conventional image forming apparatus with toner cleaning means and in the position thereafter.

The result for the measurement after the toner is passed through the first electro-conductive brush 13a is the reverse from the conventional image forming apparatus wherein the toner is equalized with the single electrode type brush (see FIG. 2) is obtained.

The result for the measurement after the toner is passed through the second electro-conductive brush 13b is a nearly constant value (approx. 0.13) which is much smaller than the threshold value 0.2 of occurrence of memory.

Figure 7:
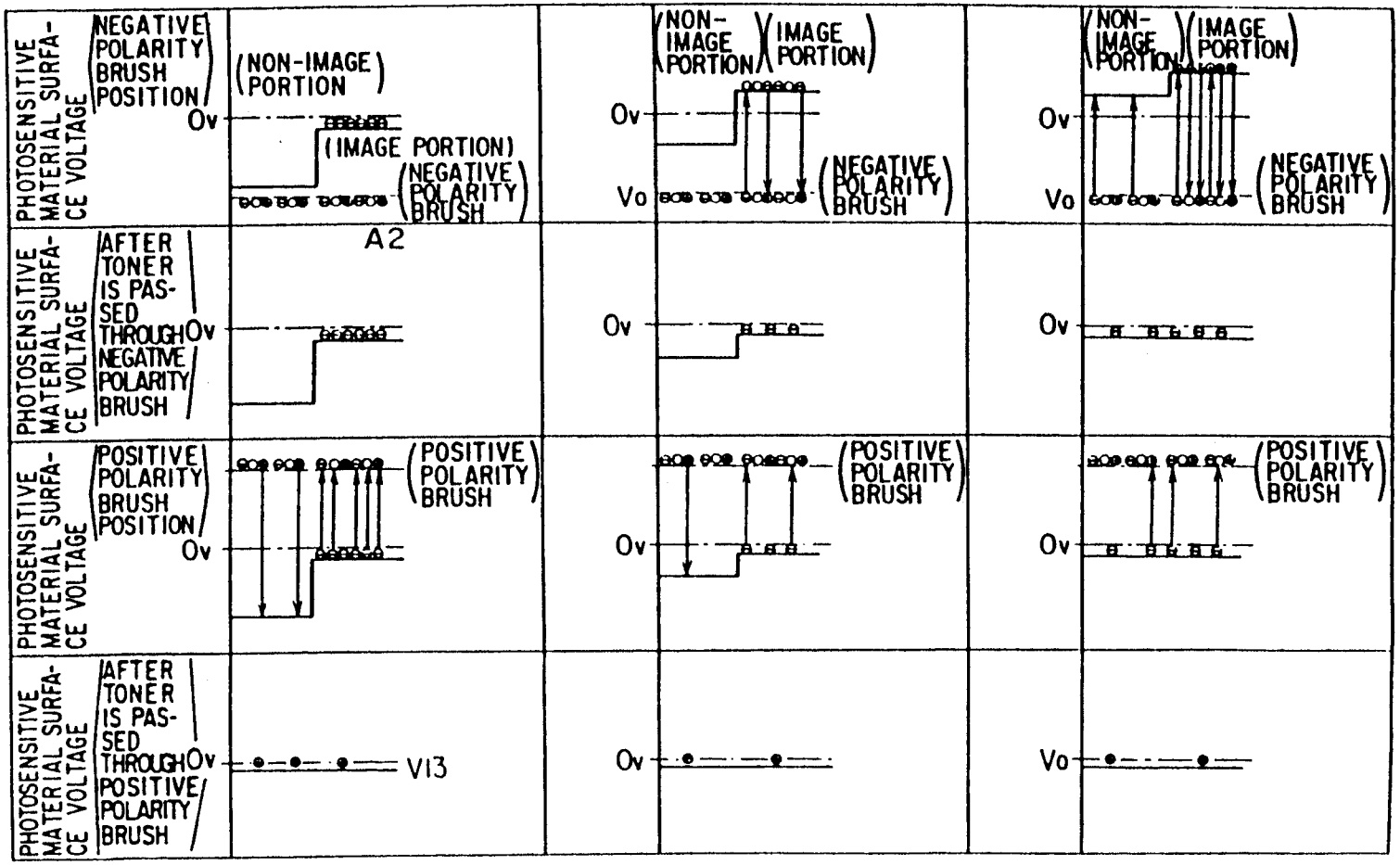
FIG. 7 is a chart showing the relationship between a residual toner distribution and a transfer corona voltage after toner is transferred and those after passed through the position of the residual toner clearance means of the image forming apparatus according to the present invention.

This result will be further described according to the case where the toner is equalized with the single electrode type brush by referring to FIG. 7. The figure shows the relationship between the toner emission and attraction and the surface condition of the photosensitive drum 1 in the position of and after the negatively charged first electro-conductive brush 13a and in the position of and after the positively charged second electro-conductive brush 13b.

In the case where transfer corona voltage $V_t = 4.4$ kV:

After the toner is transferred, the residual toner is passed through the negatively charged first electro-conductive brush 13a. In the position of the first electro-conductive brush 13a, the surface voltage both at the image portion and the non-image portion of the photosensitive drum 1 slightly changes in the positive direction because the moving amount of the positive electric charge from the transfer unit 5 is small. At the same time, since the residual toner 3a is negatively charged, the Coulomb's force acts thereon in the direction where it prevents the residual toner 3a from moving to the first electro-conductive brush 13a. On the other hand, since the potential between the first electro-conductive brush 13a and the non-image portion is low, the first electro-conductive brush 13a does not emit the toner. In addition, since the potential is low, the moving amount of the electric charge is small. Thus, after the toner is passed through the first electro-conductive brush 13a, the residual toner density and the surface voltage of the photosensitive drum 1 do not significantly change.

Then, the residual toner 3a is passed through the positively charged second electro-conductive brush 13b. In the position of the second electro-conductive brush 13b, since the condition of the residual toner and the surface voltage of the photosensitive drum 1 are nearly same as those after the toner is transferred, at the image portion, the residual toner 3a is attracted; at the non-image portion, the residual toner 3a is emitted. Thus, after the toner is passed through the second electro-conductive brush 13b, the residual toner 3a is equalized and there is almost no potential between the image portion and the non-image portion on the surface of the photosensitive drum 1.

In the case where transfer corona voltage is 4.9 kV:

The voltage of the first electro-conductive brush 13a which is normally negatively charged changes in the positive direction because the positive electric charge is moved from the transfer unit 5 to the surface voltage of the photosensitive drum 1. At the same time, the charging amount of the residual toner 3a is nearly 0. At this time, both positively charged toner particles and negatively charged toner particles are present in the residual toner 3a and thereby the total charging amount nearly becomes 0. Thus, at the image portion, the Coulomb's force which moves the positively charged toner particles of the residual toner 3a to the first electro-conductive brush 13a works. In addition, since the potential between the image portion and the first electro-conductive brush 13a is larger than that between the non-image portion and the first electro-conductive brush 13a, at the image portion, the negatively charged toner particles are emitted from the first electro-conductive brush 13a. Likewise, the moving amount of the electric charge to the image portion is larger than that to the non-image portion. Thus, after the toner is passed through the first electro-conductive brush 13a, the residual toner density is determined by the difference between the attraction and emission thereof. At this time, the positively charged toner particles of the residual toner 3a are moved to the first electro-conductive brush 13a. The residual toner particles which are not moved are negatively charged by friction thereof, charge injection, and discharging.

After that, in the position of the second electro-conductive brush 13b, since the residual toner condition and surface voltage at the image portion are nearly same as those in the case where transfer corona voltage is 4.4 kV, at the image portion, the residual toner 3a is attracted. In addition, since the potential between the non-image portion and the second electro-conductive brush 13b is low, the amount of emission of residual toner form the second electro-conductive brush 13b is small. Thus, after the toner is passed through the second electro-conductive brush 13b, the residual toner 3a is equalized and the potential between the image portion and the surface of the photosensitive drum 1 and that between the non-image portion and the surface of the photosensitive drum 1 is nearly same.

In the case where transfer corona voltage $V_l$ is 5.4 kV:

In the position of the negatively charged first electro-conductive brush 13a, the surface voltage of the photosensitive drum 1 is remarkably changed in the positive direction because the positive electric charge is moved from the transfer unit 5. On the other hand, since the residual toner 3a is positively charged, the Coulomb's force which moves the residual toner 3a to the direction of the first electro-conductive brush 13a works. Moreover, since both the potentials between the image portion and the first electro-conductive brush 13a and between the non-image portion and the first electro-conductive brush 13a are relatively high, the negatively charged toner particles are emitted from the first electro-conductive brush 13a. In addition, both at the image portion and the non-image portion, the electric charge is sufficiently moved. Thus, after the toner is passed through the first electro-conductive brush 13a, the residual toner density is determined by the difference between the attraction and emission thereof. At the non-image portion, the emitted toner particles which are negatively charged are adhered. The surface voltage of the photosensitive drum 1 is negatively charged.

After that, the residual toner 3a is passed through the second electro-conductive brush 13b which is positively charged. In the position of the second electro-conductive brush 13b, the charging conditions of the residual toner 3a and the surface voltage both at the image portion and the non-image portion are the same as those in the case where transfer corona voltage is 4.4 kV and thereby the residual toner 3a is attracted both at the image portion and the non-image portion. In other words, after the toner is passed through the second electro-conductive brush 13b, the residual toner 3a is equalized and the potential between the image portion and the surface of the photosensitive drum 1 is nearly same as that between the non-image portion and the surface of the photosensitive drum 1, namely, their potentials are nearly 0.

As described above, according to the image forming apparatus of the present invention, even if the charging condition of the residual toner 3a and the surface voltage of the photosensitive drum 1 remarkably change, a constant residual toner density can be obtained. We think that the reason why such the result is obtained is as follows.

The first electro-conductive brush 13a which is negatively charged (negative electrode) causes the residual toner to be negatively charged and the surface voltage of the photosensitive drum 1 to be nearly 0. Thus, when the toner is passed through the positively charged second electro-conductive brush 13b (positive electrode), the charging state of the residual toner 3a and the surface voltage of the photosensitive drum 1 are constantly maintained. Thereby, the attraction and emission operations of the toner are performed and maintained by the second electro-conductive brush 13b.

Embodiment 2

In the image forming apparatus shown in FIG. 4, a Scorotron type transfer unit rather than the Corotron type transfer unit 5 may be used. In other words, by using the Scorotron type transfer unit where a grid is opposed to the recording paper 6 and a transfer grid voltage is applied to the grid rather than by using the Corotoron type transfer unit 5, the electric charge which moves from the wire 5a to the recording paper 6 is controlled by an electric field which is produced between the transfer grid and the rear surface (transfer grid side) of the transfer material 6 so that the surface voltage on the rear surface of the transfer material 6 does not exceed the grid voltage. For example, the moving amount of the electric charge to the surface of the photosensitive drum 1 and the toner through the recording paper 6 is always controlled in a predetermined range.

With the image forming apparatus described above, an image is formed according to the embodiment 1 (except that the grid voltage of the transfer unit is 0.6 kV) and the relationship between the residual toner density and the transfer corona voltage is evaluated. The results we obtained are as follows. The residual toner density after the toner is transferred is minimum when the corona voltage $V_l$ ranges from 4.2 kV to 4.8 kV and that after the toner is transferred to the second electro-conductive brush 13b is around 0.13. In other words, in this embodiment, by setting the corona voltage $V_l$ in the range from 4.2 kV to 4.8 kV, the residual toner 3a and the emitted toner density after the toner is transferred are minimized. In addition, the residual toner density after the toner is passed through the second electro-conductive brush 13b substantially becomes 0 (the occurrence of memory can be perfectly prevented).

Figure 8:
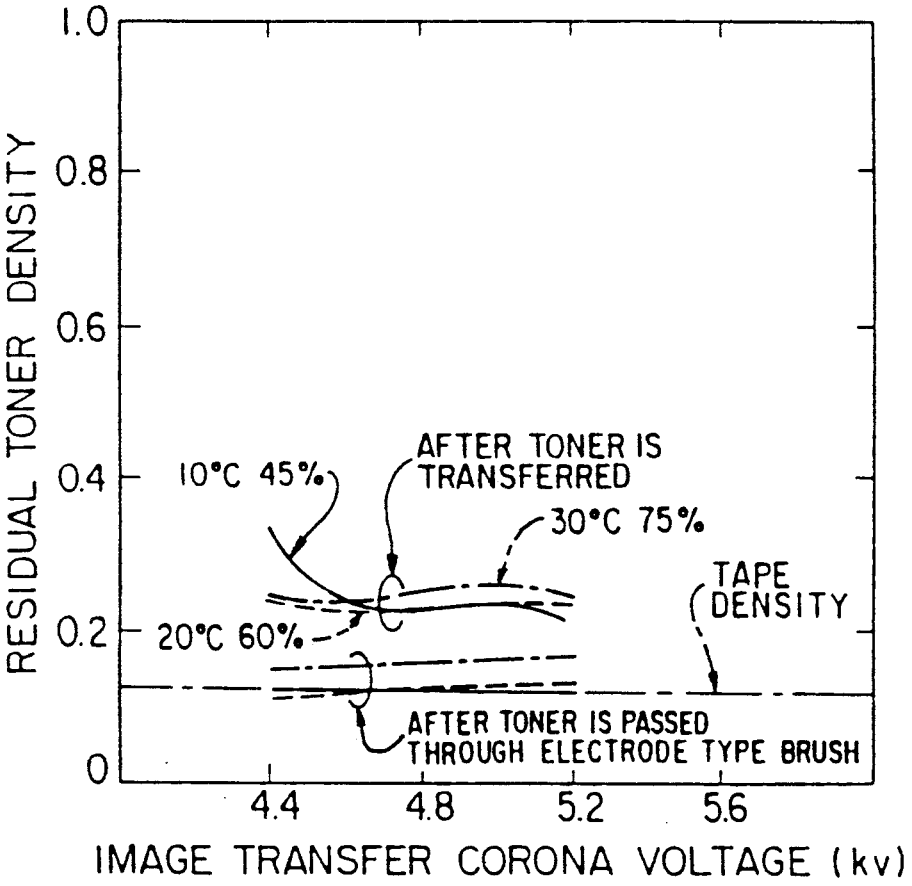
FIG. 8 is a chart showing the relationship between the characteristics of a recording paper of the image forming apparatus according to the present invention, a residual toner density and transfer corona voltage after toner is transferred and those after passed through the position of the residual toner clearance means.

After the recording paper 6 is placed in environmental conditions such as those where temperature and relative humidity are 10° C. and 45 %; 20° C. and 60 %; and 30° C. and 75 %, using the above image, the residual toner density after the toner is transferred and that after the toner is passed through the second electro-conductive brush 13b are evaluated and the results we obtained are as shown in FIG. 8.

According to the present embodiment, since a low residual toner density which is required for forming highly precise images regardless of the characteristics of the recording paper 6 and image patterns can be obtained in a constant level, the cleaner-less image forming apparatus can form various high quality images.

In the above embodiment, it is possible to apply the charging grid voltage of the corotoron type charger 9 to the first electro-conductive brush 13a, to apply the transfer grid voltage to the second electro-conductive brush 13b, and to ground the transfer grid through a Zener diode. In other words, without a power supply for the first electro-conductive brush 13a and the second electro-conductive brush 13b, the same operation and effect as the embodiment described above can be obtained.

Embodiment 3

We have made an image forming apparatus according to the embodiment 2 shown in FIG. 4 wherein the Scorotron type transfer unit is used, the grid being opposed to the recording paper 6, a transfer grid voltage being applied to the grid, a positive voltage and a negative voltage being applied to the first electro-conductive brush 13a and the second electro-conductive brush 13b, respectively rather than using the Corotron type transfer unit 5.

According to the embodiment 2, by using the above image forming apparatus, an image is formed. Regardless of the environmental condition for forming images and the type of the recording paper 6, the surface voltage of the photosensitive drum 1 is controlled in a constant level. The surface voltage of the photosensitive drum 1 both at the image portion and the non-image portion after the toner is transferred is nearly 0. As the charging condition of the residual toner after the toner is transferred, since the amount of residual toner is minimum, the charging amount is nearly 0. Thus, in this embodiment, the residual toner 3a after the toner is transferred is passed through the first electro-conductive brush 13a which is the positive electrode. Since the charging amount of the residual toner 3a is nearly 0, the Coulomb's force which acts on the residual toner 3a is small and the first electro-conductive brush 13a which is the positive electrode against the image portion does not almost attract the residual toner 3a (the residual toner is positively charged by the first electro-conductive brush 13a). In addition, at the non-image portion, the first electro-conductive brush 13a which is the positive electrode emits small amount of toner. Thus, after the toner is passed through the first electro-conductive brush 13a, the residual toner density slightly changes both at the image portion and the non-image portion. In addition, at this time, the surface voltage of the photosensitive drum 1 changes in the positive direction.

After that, the residual toner is passed through the second electro-conductive brush 13b which is the negative electrode. In the position of the second electro-conductive brush 13b, the residual toner 3a is positively charged. Thus, the residual toner is attracted by the second electro-conductive brush 13b as well as the positively charged toner adhered at the non-image portion. On the other hand, since the potential between the image portion and the non-image portion is low, the amount of toner emitted from the second electro-conductive brush 13b is small. Thus, after the toner is passed through the second electro-conductive brush 13b which is the negative electrode, the residual toner 3a is equalized. The potential between the image portion and the non-image portion on the photosensitive drum 1 becomes 0. Thus, a low residual toner density required for forming highly precise images can be obtained in a constant level.

Embodiment 4

We have made an image forming apparatus according to the embodiment 2 shown in FIG. 4 wherein the Scorotoron type transfer unit is used, the grid being opposed to the recording paper 6, a transfer grid voltage being applied to the grid, a positive voltage being applied to the first electro-conductive brush 13a, the second electro-conductive brush 13b being an earth brush which is grounded rather than using the Corotoron type transfer unit 5.

According to the embodiment 2, by using the above image forming apparatus, an image is formed. Regardless of the environmental condition for forming images and the type of the recording paper 6, the surface voltage of the photosensitive drum 1 is controlled in a constant level. The surface voltage of the photosensitive drum 1 both at the image portion and the non-image portion after the toner is transferred is nearly 0. As the charging condition of the residual toner after the toner is transferred, since the amount of residual toner is minimum, the charging amount is nearly 0. Thus, in this embodiment, the residual toner 3a after the toner is transferred is passed through the first electro-conductive brush 13a which is the positive electrode. At this time, since the charging amount of the residual toner 3a is nearly 0, the Coulomb's force which acts on the residual toner 3a is small and thereby the first electro-conductive brush 13a which is the positive electrode against the image portion does not almost attract the residual toner 3a (the residual toner is positively charged by the first electro-conductive brush 13a). In addition, at the non-image portion, the first electro-conductive brush 13a which is the positive electrode emits small amount of toner. Thus, after the toner is passed through the first electro-conductive brush 13a, the residual toner density slightly changes both at the image portion and the non-image portion. In addition, at this time, the surface voltage of the photosensitive drum 1 changes in the positive direction. When the resistance of the first electro-conductive brush 13a is set at $10^3$ to $10^5$ Ω cm, the electric charge easily moves, thereby positively charging the surface of the photosensitive drum 1.

Although the residual toner 3a is passed through the second electro-conductive brush 13b which is the earth brush, in the position of the second electro-conductive brush 13b, the residual toner 3a at both the image portion and the non-image portion is positively charged. In addition, since there is a sufficient potential between the surface of the photosensitive drum 1 and the second electro-conductive brush 13b, the residual toner 3a is attracted by the earth brush 13b. After the toner is passed through the earth brush 13b, the residual toner 3a is equalized and the surface voltage of the photosensitive drum 1 is charged to approximately 0 V. Thus, a low residual toner density which is required for forming highly precise images can be obtained in a constant level. In addition, in this embodiment, since the second electro-conductive brush 13b is grounded, the power supply thereof is not required.

Embodiment 5

We have made an image forming apparatus according to the embodiment 2 shown in FIG. 4 wherein the Scorotron type transfer unit is used, the grid being opposed to the recording paper 6, a transfer grid voltage being applied to the grid, and a negative voltage being applied to the first electro-conductive brush 13a, the second electro-conductive brush 13b being an earth brush which is grounded rather than using the Corotron type transfer unit 5.

According to the embodiment 2, by using the above image forming apparatus, an image is formed. Regardless of the environmental condition for forming the image and the type of the recording paper 6, the surface voltage of the photosensitive drum 1 is controlled in a constant level. The surface voltage of the photosensitive drum 1 both at the image portion and the non-image portion after the toner is transferred is nearly 0. As the charging condition of the residual toner after the toner is transferred, since the amount of residual toner is minimum, the charging amount is nearly 0. Thus, in this embodiment, the residual toner 3a after the toner is transferred is passed through the first electro-conductive brush 13a which is the negative electrode. Since the charging amount of the residual toner 3a is nearly 0, the Coulomb's force which causes the positively charged toner particles of the residual toner to move in the direction of the first electro-conductive brush 13a works at the image portion. On the other hand, the first electro-conductive brush 13a emits the negatively charged toner particles. After the toner is passed through the first electro-conductive brush 13a which is the negative electrode, the residual toner density slightly changes at the image portion (the residual toner is negatively charged by the first electro-conductive brush 13a). The surface voltage of the photosensitive drum 1 remarkably changes in the negative direction because the first electro-conductive brush 13a is used. There is no potential between the image portion and the non-image portion.

Although the residual toner 3a is passed through the second electro-conductive brush 13b which is the earth brush, in the position of the second electro-conductive brush 13b, the residual toner 3a at both the image portion and the non-image portion is negatively charged. In addition, since there is a sufficient potential between the surface of the photosensitive drum 1 and the second electro-conductive brush 13b, the residual toner 3a is attracted by the second electro-conductive brush 13b. After the toner is passed through the second electro-conductive brush 13b, the residual toner 3a is equalized and the surface voltage of the photosensitive drum 1 is charged to approximately 0 V. Thus, a low residual toner density which is required for forming highly precise images can be obtained in a constant level. In addition, in this embodiment, since the second electro-conductive brush 13b is grounded, the power supply thereof is not required.

Embodiment 6

We have made an image forming apparatus according to the embodiment 2 shown in FIG. 4 wherein the Scorotron type transfer unit is used, the grid being opposed to the recording paper 6, a transfer grid voltage being applied to the grid, the first electro conductive brush 13a being an earth brush which is grounded, a positive voltage being applied to the second electro-conductive brush 13b rather than using the Corotron type transfer unit 5.

According to the embodiment 2, by using the above image forming apparatus, an image is formed. Regardless of the environmental condition for forming images and the type of the recording paper 6, the surface voltage of the photosensitive drum 1 is controlled in a constant level. The surface voltage of the photosensitive drum 1 both at the image portion and the non-image portion after the toner is transferred is nearly 0. As the charging condition of the residual toner after the toner is transferred, since the amount of residual toner is minimum, the charging amount is nearly 0. In this embodiment, although the residual toner 3a after the toner is transferred is passed through the first electro-conductive brush 13a which is the earth brush, since the charging amount of the residual toner 3a is nearly 0 and the potential between the first electro-conductive brush 13a and the image portion and that between the first electro-conductive brush 13a and the non-image portion are small, the toner does not almost move both at the image portion and the non-image portion. In other words, after the toner is passed through the first electro-conductive brush 13a, the residual toner density does not change both at the image portion and the non-image portion. When the first electro-conductive brush 13a contains silicone, for example, so that the toner is negatively charged as frictionally charging characteristic, the residual toner 3a is negatively charged by the first electro-conductive brush 13a.

After that, although the residual toner 3a is passed through the second electro-conductive brush 13b, in the position of the second electro-conductive brush 13b, the residual toner 3a at the image portion is negatively charged. In addition, since there is a sufficient potential between the image portion and the second electro-conductive brush 13b, the residual toner 3a is attracted by the second electro-conductive brush 13b which is the positive electrode. On the other hand, at the non-image portion, the second electro-conductive brush 13b which is the positive electrode emits the positively charged toner particles. Thus, the residual toner 3a is equalized and the surface voltage of the photosensitive drum 1 is positively changed. In other words, a low residual toner density which is required for forming highly precise images can be obtained in a constant level.

Embodiment 7

We have made an image forming apparatus according to the embodiment 2 shown in FIG. 4 wherein the Scorotron type transfer unit is used, the grid being opposed to the recording paper 6, a transfer grid voltage being applied to the grid, the first electro-conductive brush 13a being an earth brush which is grounded, a negative voltage being applied to the second electro-conductive brush 13b rather than using the Corotron type transfer unit 5.

According to the embodiment 2, by using the above image forming apparatus, an image is formed. Regardless of the environmental condition for forming images and the type of the recording paper 6, the surface voltage of the photosensitive drum 1 is controlled in a constant level. The surface voltage of the photosensitive drum 1 both at the image portion and the non-image portion after the toner is transferred is nearly 0. As the charging condition of the residual toner after the toner is transferred, since the amount of residual toner is minimum, the charging amount is nearly 0. In this embodiment, although the residual toner 3a after the toner is transferred is passed through the first electro-conductive brush 13a which is the earth brush, since the charging amount of the residual toner 3a is nearly 0 and the potential between the first electro-conductive brush 13a and the image portion and that between the first electro-conductive brush 13a and the non-image portion are low, the toner does not almost move both at the image portion and the non-image portion. In other words, after the toner is passed through the first electro-conductive brush 13a, the residual toner density does not change both at the image portion and the non-image portion. When the first electro-conductive brush 13a contains ethylene tetrafluoride, for example, so that the toner is positively charged as frictionally charging characteristic, the residual toner 3a is positively charged by the first electro-conductive brush 13a.

After that, although the residual toner 3a is passed through the second electro-conductive brush 13b which is the negative electrode, in the position of the second electro-conductive brush 13b, the residual toner 3a at the image portion is positively charged. In addition, since there is a sufficient potential between the image portion and the second electro-conductive brush 13b, the residual toner 3a is attracted by the second electro-conductive brush 13b which is the negative electrode. On the other hand, at the non-image portion, the second electro-conductive brush 13b which is the negative electrode emits the negatively charged toner particles. Thus, the residual toner 3a is equalized and the surface voltage of the photosensitive drum 1 is positively changed. In other words, a low residual toner density which is required for forming highly precise images can be obtained in a constant level.

Embodiment 8

We have made an image forming apparatus according to the embodiment 2 shown in FIG. 4 wherein the Scorotron type transfer unit is used, the grid being opposed to the recording paper 6, a transfer grid voltage being applied to the grid, the charge removing lamp 8 and the charger 9 being removed, a positive voltage being applied to the first electro-conductive brush 13a, the resistance of the second electro-conductive brush 13b being set to $10^3$ to $10^5$ Ω cm, a negative voltage which is Vo or less being applied to the second electro-conductive brush 13b, rather than using the Corotron type transfer unit 5.

In this embodiment, after the toner is passed through the second electro-conductive brush 13b where the negative voltage is applied, the surface voltage of the photosensitive drum 1 at the image portion is the same as that at the non-image portion, both the image portion and the non-image portion being negatively charged. Thus, even if the charge removing lamp 8 and the charger 9 are not provided, a low residual toner density which is required for forming highly precise images can be obtained in a constant level.

In the above embodiments, the photosensitive drum which comprises a negatively charged type organic photosensitive layer as a latent image holding member is described. It is possible to use selenium type, non-crystal silicone, and the like as the photosensitive material. In addition, as the development method, it is also possible to use the one-component development method instead of the two-component development method.

In addition, in the above embodiments, as electrode members which have a potential, which are the residual toner image equalization means, it is also possible to use, for example, electro-conductive elastic rollers or rotating brushes comprising electro-conductive fiber instead of the electro-conductive brushes. In other words, when using the rotating brushes, the limit for holding toner becomes large. Thus, the amount for attracting toner can be increased. On the other hand, when using the electro-conductive elastic rollers, since they can be securely contacted with the photosensitive drum, the Coulomb's force against the residual toner can be kept constant. In addition, the frictional charging performance against toner and the charging performance against the photosensitive drum are improved and thereby the attraction and emission of the toner can be easily controlled.

Moreover, as described above, in the means for equalizing the residual toner, after the toner is passed through the second electrode member (last stage electrode member), when there is almost no potential between the image portion and the non-image portion, the charge removing process using the charge removing lamp 8 on the photosensitive drum is not required.

As described above, in the first image forming apparatus according to the present invention, the cleaner unit and toner disposal vessel are not required. In addition, the toner can be reused. Moreover, regardless of the environmental condition, recording paper type, and image pattern to be formed, high quality images can be easily and securely formed. In other words, a residual toner density which is required for forming highly precise images can be always kept. Thus, high quality images can be clearly formed without defects such as memory.

Embodiments according to second means and third means of the present invention will be described in the following.

In second means of the present invention, the elastic foaming substance which is in contact with the electrostatic latent image holding member as the equalization member has more excellent toner image disturbing function than the conventional electro-conductive brush described above. Thus, without an electric field being produced, the residual toner image can be equally distributed. Consequently, even if the charging polarity of the residual toner is reversed in a high humidity condition, the toner is easily and equally distributed and thereby a ghost can be securely prevented. Particularly, when the elastic foaming substance as the equalization member is electro-conductive, by applying a voltage whose polarity is the same as the charged polarity of the toner particles, even if solid images are successively output, a large amount of toner does not stay on the equalization member.

In addition, in the second means of the present invention, an AC electric field is produced between the equalization member and the latent image holding material and thereby a vibration motion is given to the residual toner particles. Thus, since the toner can be easily and equally distributed, the toner does not stay on the equalization member. In addition, since the electric field is alternatively changed, even if the residual toner is reversely charged, the vibration motion can be given to the toner. Thus, by clearing the residual toner image distributed, the occurrence of the ghost can be prevented.

Embodiment 9

Figure 9:
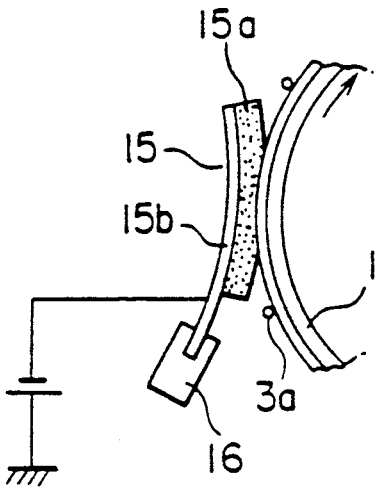
FIGS. 9 to 14 are sectional views showing different principal structures of the image forming apparatus according to the present invention.

FIG. 9 shows a sectional view of the principal portion of an embodiment of the image forming apparatus according to the present invention. Particularly, the figure shows an enlarged view of the vicinity of the equalization member 15 for disturbing the residual toner or residual toner (image) 3*a* and for equally distributing it. The equalization member 15 chiefly comprises the foaming substance 15*a* such as polyurethane, silicone, chloroprene, or NBR, the equalization member 15 being disposed so that it is pressed to the surface of the photosensitive drum 1 by the supporting member 15*b*. When the supporting member 15*b* is formed by a resilient member such as a phosphorus bronze plate or stainless plate whose thickness ranges from 0.1 to 0.5 mm, since it can always press the foaming substance 15*a* at a constant pressure, more preferred results can be obtained. 16 is a fastener for fastening the supporting member 15*b* to the recording unit. Since the foaming substance 15*a* which comprises the materials described above has forming cells whose average diameter ranges from several microns to several millimeters, it provides much more excellent performance for disturbing the residual toner 3*a* adhered on the surface of the photosensitive drum 1 and for clearing or equalizing it than that of the conventional fiber brushes. In other words, most of the conventional fiber brushes do not have the function for mechanically disturbing toner images. Thus, conventionally, without a process where toner is temporarily attracted by an electric field and the toner is emitted when the amount of toner which stays on the brush exceeds the limit thereof, the equalization operation cannot be obtained. However, according to the present invention using foaming substance, the residual toner image 3*a* can be disturbed and equalized only with the mechanical operation. To effectively accomplish this function, it is preferred that the number of cells of the foaming substance ranges from 20 pieces/25 mm to 300 pieces/25 mm.

Although the thickness of the foaming substance 15*a* should be determined depending on the number of cells, the practical thickness ranges from 1 mm to 10 mm. It is preferred that the side surface (or belly surface) of the foaming substance sheet 15*a* is contacted with the photosensitive drum 1 as shown in the figure. When the edge of the foaming substance sheet 15*a* is contacted with the photosensitive drum 1, this portion causes the toner to be scraped off and thereby the toner is spilled. Particularly, because of the motion of the surface of the photosensitive drum 1, it is not preferred to cause the edge of the foaming substance sheet 15*a* to be contacted with the photosensitive drum 1.

In FIG. 9, the supporting plate 15*b* is secured on the upstream side viewed from the photosensitive drum 1. However, it is possible to secure the supporting plate 15*b* on the downstream side. Moreover, to further effectively accomplish the equalization function, it is possible to apply a voltage to the foaming substance 15*a*. In the structure where the foaming substance 15*a* is non-electro-conductive and a voltage is applied to the supporting member 15*b*, it is preferred to set the distance between the photosensitive drum 1 and the supporting member 15*b* to 0.2 mm or 2.0 mm and to apply a voltage of ±100 V or ±3000 V therebetween.

Although it is preferred that the polarity of the voltage is the same as the that of the toner being charged and the most of toner being scraped off is emitted so that the toner is not adhered to the foaming substance 15*a*, if the size of the foaming cell is small and the toner holding performance is low, it is possible to apply a voltage for attracting the toner. In addition, when the charging polarity of the residual toner 3*a* varies depending on the humidity condition, by manually or automatically changing the polarity of the electric charge being applied, an excellent equalization operation can be accomplished.

Figure 10:
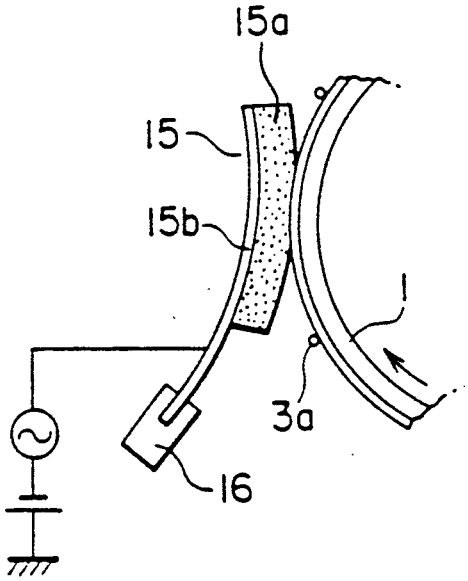

In addition, when the foaming substance 15*a* is a conductive substance or a resistor whose resistance is $10^9$ Ω· cm or less, the equalization operation by the electric field can be further improved. In this case, it is preferred to set the voltage being applied in the range from ±50 to ±1000 V. In addition, when an AC voltage whose frequency ranges from 50 Hz to 5 kHz and whose peak-to-peak value ranges from 100 V to 4000 V or a voltage where a DC voltage is overlapped thereto is applied, a reciprocating motion can be given to the residual toner 3*a* and thereby a better equalization effect can be accomplished (see FIG. 10).

Figure 11:
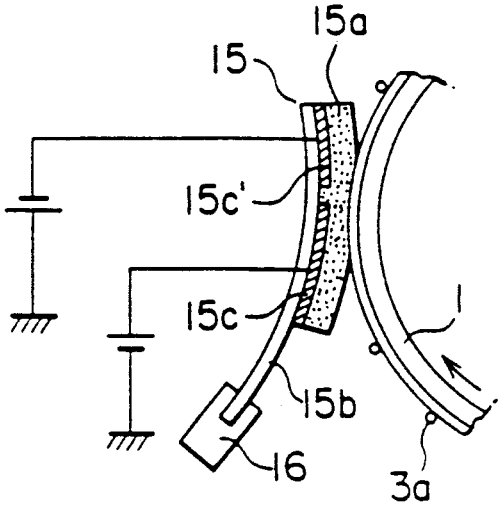

On the other hand, as shown in FIG. 11 which is a sectional view of the principal section, by applying a voltage so that there is a potential between the upstream side and the downstream side of the photosensitive drum 1, the equalization function can be further improved. In other words, by applying a voltage for attracting the residual toner 3*a* to the upstream side of the photosensitive drum 1 through the electrode 15*c* and a voltage for emitting the residual toner 3*a* to the downstream of the photosensitive drum 1 through the electrode 15*c*', the supporting member 15*b* being an insulator, the residual toner image can be securely disturbed. In addition, since the toner can be securely emitted, it is possible to prevent the toner from staying on the equalization member 15.

Figure 12:
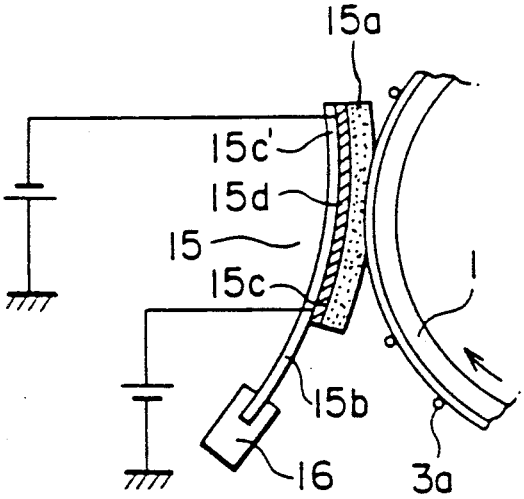
Figure 13:
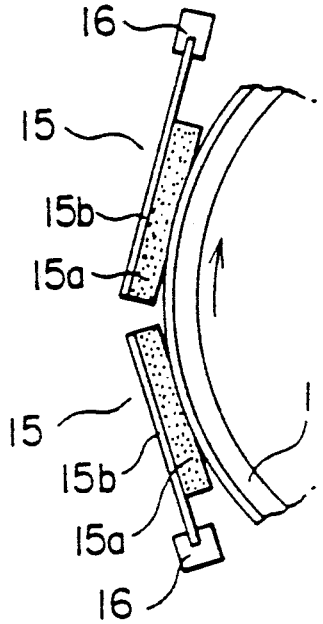

As shown in FIG. 12, it is possible to form the equalization member 15 so that the foaming substance 15*a* is coated with the resistance layer 15*d*. In this structure, by applying a toner attracting voltage and a toner emitting voltage to the electrode 15*c* and the electrode 15*c*', respectively, a potential slope occurs in the resistance layer 15*d* and thereby the residual toner 3*a* can be smoothly and continuously attracted and emitted. Thus, the effect accomplished in the structure shown in FIG. 11 can be much securely obtained. The effect which can be accomplished in the structure shown in FIGS. 11 and 12 can be obviously obtained by disposing a plurality of the equalization members 15 as sectionally shown in FIG. 13.

Figure 15:
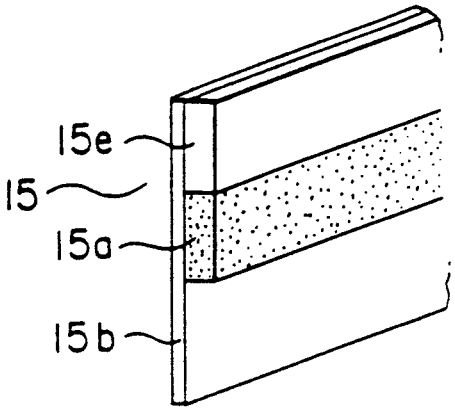
FIG. 15 is a perspective view showing an example of the structure of an equalization member that the image forming apparatus according to the present invention provides.
Figure 14:
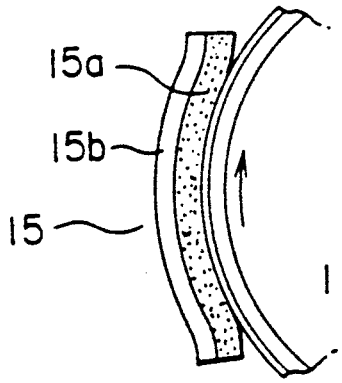

As another deformed example of the present invention, as sectionally shown in FIG. 14, the contacting area of the foaming substance 15*a* and the electrostatic latent image holding member 1 can be large. In addition, by perspectively shown in FIG. 15, the equalization member 15 comprising the foaming substance 15*a* having a foaming surface of the upstream side of the electrostatic latent image holding member 1 and the elastic substance 15*e* having a smooth surface on the downstream thereof. In the example shown in FIG. 15, since the surface of the foaming substance 15*a* disturbs the residual toner 3*a* and the smooth surface of the elastic substance 15*e* equalizes it, the occurrence of ghost can be much effectively prevented.

Figure 16:
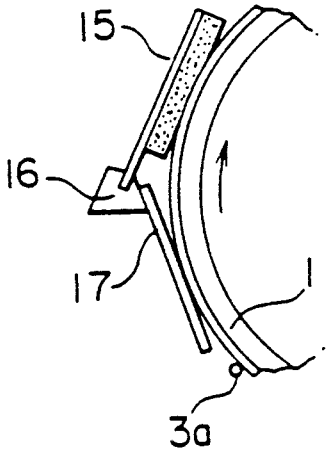
FIGS. 16 and 17 are sectional views showing different principal structures of the image forming apparatus according to the present invention.

The smooth surface of the elastic substance 15*e* can be formed by thermally processing the surface of the foaming substance 15*a*. Moreover, it can be formed by sticking a smooth sheet such as a polyester film, Teflon film, nylon film, silicone film, nylon film, silicone rubber film, urethane rubber sheet on the foaming substance 15*a*. Furthermore, it is possible to form it by using a foaming substance whose foam is very small or solid rubber. If the toner drops downwardly from the contact position of the foaming substance 15*a* and the electrostatic latent image holding member 1, as sectionally shown in FIG. 16, it can be prevented by disposing a smooth recover sheet 17 so that the belly portion is lightly contacted with the photosensitive drum 1.

Figure 17:
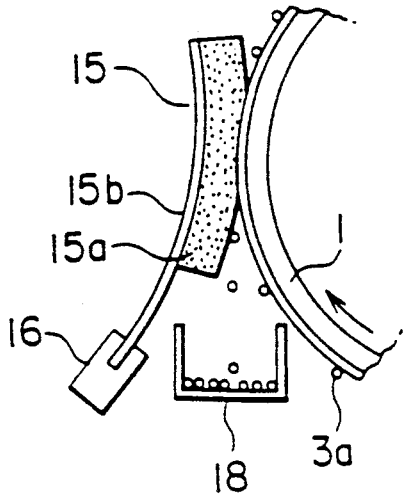

As the recover sheet 17, an urethane sheet, silicone rubber sheet, polyester film, silicone rubber sheet, polyester film, polyethylene terephthalate film, and so forth whose thickness ranges from 0.1 mm to 1.0 mm is preferable. As sectionally shown in FIG. 17, it is possible to collect the dropped toner with the toner collection tray 18. When disposing of the photosensitive drum 1 along with the equalization member 15 and the toner collection tray 18 at the same time, it is practically possible to disregard the toner which stays in the toner collection tray 18.

Figure 19:
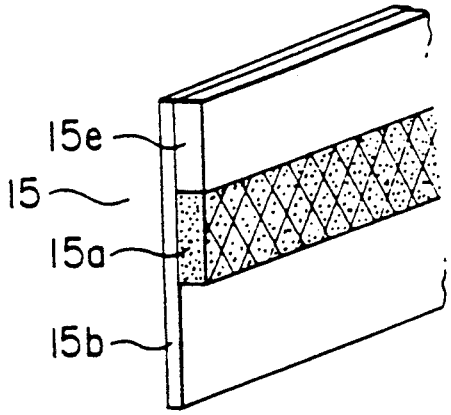
FIGS. 18 and 19 are perspective views showing different structures of the equalization member that the image forming apparatus according to the present invention provides.
Figure 18:
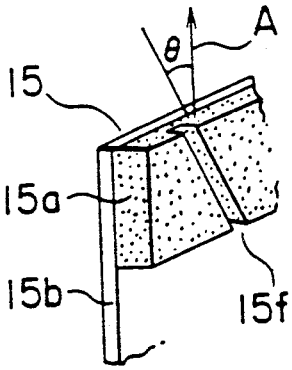

As perspectively shown in FIG. 18, when the groove 15*f* is provided on the foaming substance 15*a*, the groove 15*f* having an angle ranging of $0° < \theta < 90°$ against the moving direction A of the electrostatic latent image holding member 1, a motion which is perpendicular to the moving direction of the photosensitive drum 1 can be given to the residual toner 3*a*. Thus, it is possible to much securely disturb the toner image. When the foaming substance 15*a* with the groove 15*f* is disposed on the upstream side of the electrostatic latent image holding member 1, as shown in FIG. 19, the operation and the effect of the structure shown in FIG. 15 can be securely obtained.

Figure 20:
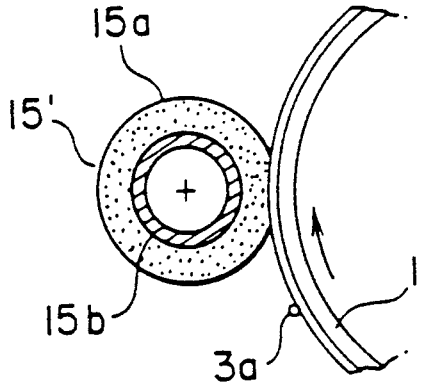
FIGS. 20 to 24 are sectional views showing different principal compositions of the image forming apparatus according to the present invention.

In addition, by forming the equalization member 15 in a roller shape as shown in FIG. 20 and by providing the foaming substance 15*a* on the outer periphery thereof, the same effect can be obtained. By rotating the equalization roller 15' at a different speed from the electrostatic latent image holding member 1, the equalization effect can be remarkably improved. In this case, even if the equalization roller 15' is intermittently rotated, the same operation and effect can be obtained.

Embodiment 10

Figure 21:
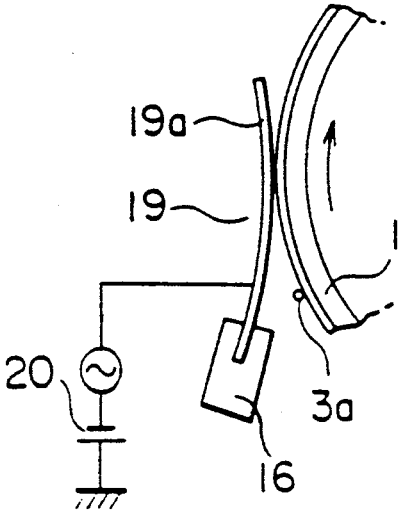

FIG. 21 is a sectional view of the principal portion describing an embodiment using third means of the present invention. An equalization member 19 consists of an electrode plate 19*a* which works as an opposed electrode against the electrostatic latent image holding member 1 and a supporting member 16 which supports the electrode plate 19*a*. To the electrode plate 19*a*, a power supply 20 is connected, the electrode plate 19*a* being contactably or approachably disposed to the electrostatic latent image holding member 1, an AC voltage being applied to the electrode plate 19*a* to produce an AC electric field between the electrode plate 19*a* and the electrostatic latent image holding member 1.

Figure 22:
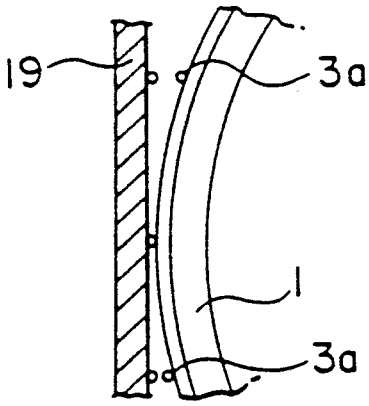

In this structure, when the value of the AC electric field exceeds a predetermined level, as sectionally shown in FIG. 22, the residual toner particles 3*a* reciprocally move between the electrostatic latent image holding member 1 and the electrode plate 19*a*. If no electrostatic latent image has not been formed on the surface of the electrostatic latent image holding member 1, the reciprocal motion of the residual toner 3*a* works so that the toner is equally distributed because of the following reason. Where the toner density is high, a repulsive force occurs between the toner particles. By repeating the reciprocal motion, the toner particles are equally distributed. Thus, when embodying the present invention, if a charge removing lamp is provided between the transfer position and the equalization member 19 position and a preprocess for equalizing the surface voltage of the electrostatic latent image holding member 1 and the like is performed, a much remarkable effect can be obtained.

As the electrode plate 19*a* of the equalization member 19, elastic metal plate consisting of phosphorus bronze plate and stainless steel or an elastic sheet or repulsive sheet which is made by dispersing conductive carbon or metal particles in a macromolecule substance such as polyester, PET, silicone rubber, urethane rubber, or Teflon can be used. As shown in FIG. 21, a remarkable effect can be obtained by disposing the electrode plate 19*a* so that its belly surface is contacted with the electrostatic latent image holding member 1. In such a structure, small openings can be formed in the vicinity of the contact position as shown in FIG. 22.

Figure 23:
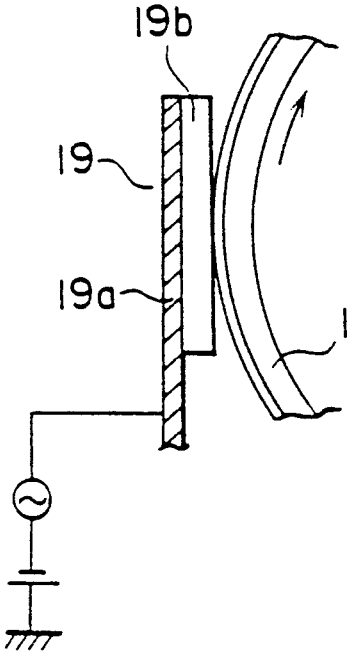

When the conductive plate or sheet which works as the equalization member 19 is contacted with the electrostatic latent image holding member 1, it is preferred to place a protection resistor ranging from $10^3\ \Omega$ to $10^9\ \Omega$ between an AC power supply 20 and the equalization member 19 to limit the current. In this structure, the dielectric breakdown of the electrostatic latent image holding member 1 can be protected. To accomplish the same effect, it is possible to make the opposed electrode with a material whose resistance ranges from $10^3\ \Omega \cdot$ cm to $10^9\ \Omega \cdot$ cm. Alternatively, as sectionally shown in FIG. 23, it is also possible to dispose a resistor layer or insulation layer 19*b* whose resistance is $10^3\ \Omega \cdot$ cm or more on the contacting surface of the electrostatic latent image holding member 1, the electrode plate 19*a* is laminated thereon, an AC voltage being applied thereon. In addition, by forming the electrode plate 19*a* with a rigid substance and by keeping a small distance between the electrode plate 19*a* and the electrostatic latent image holding member 1, the same effect as the structures shown in FIGS. 21 and 22 can be obtained.

When an AC voltage whose peak-to-peak value is 5000 V/mm or more is applied between the equalization member 19 and the electrostatic latent image holding member 1, a more effective equalization effect can be obtained. Moreover, by applying an AC voltage so that the residual toner 3*a* is attracted to the electrostatic latent image holding member 1 or so that the toner is absorbed, in order to prevent the toner from staying on the toner collection tray 18, a practically effective effect can be obtained. The frequency of the AV voltage ranges from 30 Hz to 10 kHz, preferably 50 Hz to 3 kHz.

Figure 24:
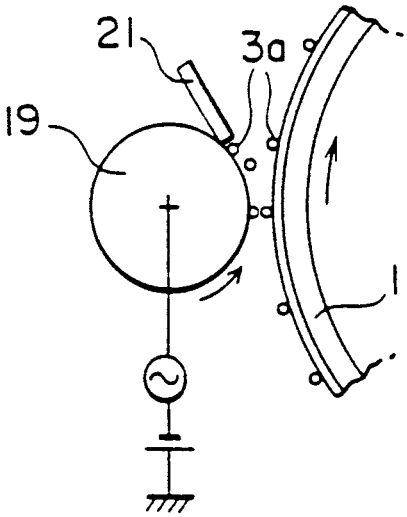

As sectionally shown in FIG. 24, by forming the equalization member 19 in a roller shape, applying the deflected voltage thereto, urging a cleaning blade 21 on the roller surface to scrape off the residual toner 3*a*, and carrying it by the electrostatic latent image holding member 1, the residual toner 3*a* can be easily equalized without the toner which stays on the equalization member 19.

In the above embodiment, it is also possible to form the equalization member 19 with an elastic substance which is in contact with the electrostatic latent image holding member 1. In addition, the structures shown in FIGS. 21 to 24 can be deformed as those shown in FIGS. 11 to 19. With these deformations, the equalization function can be further improved.

As described above, in the cleaner-less image forming apparatus, since the residual toner images can be effectively agitated and equalized, for example, under a high humidity environment, good quality images free of ghost can be formed regardless of the characteristics being applied.

What is claimed is:

1. An image forming apparatus comprising:
an electrostatic latent image holding member;
means for forming a latent image on said electrostatic latent image holding member;
a development unit for supplying and adhering toner on the latent image being formed so as to develop the latent image;
a transfer unit for transferring the latent image on an image holding material; and
residual toner image equalization means for equalizing the distribution of a residual toner image which stays on said electrostatic latent image holding member after said latent image is transferred, wherein
said development unit develops said latent image held on said electrostatic latent image holding member while attracting and collecting residual toner which remains on said electrostatic latent image holding member,
said residual toner image equalization means comprising a plurality of electrode members which are contactably and approachably disposed to said electrostatic latent image holding member.

2. The image forming apparatus according to claim 1 wherein a positive voltage is applied to a first one of said plurality of electrode members and a negative voltage is applied to a second one of said plurality of electrode members, said electrode members having a potential.

3. The image forming apparatus according to claim 1 wherein said transfer unit is Scorotron type transfer unit.

4. The image forming apparatus according to claim 1 wherein a first one of said plurality of electrode members is positively charged and a second one of said plurality of electrode members is grounded, said first and second electrode members having a potential.

5. The image forming apparatus according to claim 1 wherein a grid voltage of a Scorotron type charger is applied to a first one of said plurality of electrode members and the grid voltage of said Scorotron type transfer unit is applied to a second one of said plurality of electrode members, said first and second electrode members having a potential.

6. The image forming apparatus according to claim 1 wherein at least one of said plurality of electrode members is a plate shaped electro-conductive brush.

7. The image forming apparatus according to claim 1 wherein at least one of said plurality of electrode members is a rotation type electro-conductive brush.

8. The image forming apparatus according to claim 1 wherein said residual toner image equalization means comprises first and second electrode members having first and second potentials respectively, said first potential being higher than said second potential, the first electrode member and the second electrode member being disposed upstream and downstream of said electrostatic latent image holding member viewed from the motion thereof, respectively.

9. The image forming apparatus according to claim 1 wherein said residual toner image equalization means comprises first and second electrode members having first and second potentials respectively, the first potential being higher than said second potential, said first electrode member and said second electrode member being disposed downstream and upstream of said electrostatic latent image holding member viewed from the motion thereof, respectively.

10. The image forming apparatus according to claim 1, wherein a plurality of voltages are respectively applied to said plurality of electrode members, each of said plurality of voltages differing from the other.

11. An image forming apparatus comprising:
an electrostatic latent image holding member;
means for forming a latent image on said electrostatic latent image holding member;
a development unit for supplying and adhering toner on the latent image being formed so as to develop the latent image;
a transfer unit for transferring said latent image on an image holding material; and
residual toner image equalization means for equalizing the distribution of a residual toner image which stays on said electrostatic latent image holding member after said latent image is transferred, wherein
said development unit develops a latent image held on said electrostatic latent image holding member while attracting and collecting residual toner which remains on said electrostatic latent image holding member,
said residual toner image equalization means comprising an elastic foaming substance pressed to said electrostatic latent image holding member.

12. The image forming apparatus according to claim 11 wherein said residual toner image equalization means comprises an elastic foaming substance whose average diameter ranges from several microns to several millimeters.

13. The image forming apparatus according to claim 11 wherein said residual toner image equalization means comprises an elastic forming substance whose average number of cells ranges from 20 to 300 pieces/25 mm.

14. The image forming apparatus according to claim 11 wherein a plurality of grooves are formed on said residual toner image equalization means, said plurality of grooves having an angle of $0<\theta\leqq 90$ in the moving direction of the surface of said electrostatic latent image holding member.

15. The image forming apparatus according to claim 11 wherein said residual toner image equalization means comprises an elastic electro-conductive substance.

16. The image forming apparatus according to claim 11 wherein said residual toner image equalization means comprises said elastic forming substance and electro-conductive members, said elastic foaming substance being supported with said electro-conductive member.

17. The image forming apparatus according to claim 16 wherein the distance between the surface of said electrostatic latent image holding members and said electro-conductive member ranges from 0.2 mm to 2 mm and the potential between the surface of said electrostatic latent image holding member and said residual toner image equalization means ranges from ±100 V to ±3,000 V.

18. An image forming apparatus comprising:
an electrostatic latent image holding member;

means for forming a latent image on said electrostatic latent image holding member;

a development unit for supplying and adhering toner on the latent image being formed so as to develop the latent image;

a transfer unit for transferring said latent image on an image holding material; and residual toner image equalization means for equalizing the distribution of a residual toner image which stays on said electrostatic latent image holding member after said latent image is transferred, wherein said development unit develops said latent image held on said electrostatic latent image holding member while attracting and collecting residual toner which remains on said electrostatic latent image holding member, said residual toner image equalization means comprising an electro-conductive member or resistor member, said residual toner image equalization means being contactably or approachably disposed, means for producing an AC electric field being disposed between said residual toner image equalization means and said electrostatic latent image holding member.

19. The image forming apparatus according to claim 18 wherein said residual toner image equalization means comprises an electroconducting member or a resistance member whose resistance ranges from $10^3\ \Omega \cdot cm$ to $10^9\ \Omega \cdot cm$.

20. The image forming apparatus according to claim 18 wherein the difference of the electric field peak value between said residual toner image equalization means and the surface of said electrostatic latent image holding member is 5000 V/mm or more.

21. The image forming apparatus according to claim 18 wherein the frequency of said AC electric field ranges from 30 Hz to 10 kHz.

* * * * *